US010890087B2

(12) United States Patent
Hirschmann et al.

(10) Patent No.: US 10,890,087 B2
(45) Date of Patent: Jan. 12, 2021

(54) VARIABLE VALVE TRAIN

(71) Applicant: MAN Truck & Bus AG, Munich (DE)

(72) Inventors: Steffen Hirschmann, Neustadt An der Aisch (DE); Jens Dietrich, Heilsbronn (DE); Thomas Malischewski, Heilsbronn (DE)

(73) Assignee: MAN TRUCK & BUS AG, Munich (DE)

( * ) Notice: Subject to any disclaimer, the term of this patent is extended or adjusted under 35 U.S.C. 154(b) by 35 days.

(21) Appl. No.: 16/016,188

(22) Filed: Jun. 22, 2018

(65) Prior Publication Data

US 2019/0003353 A1 Jan. 3, 2019

(30) Foreign Application Priority Data

Jun. 29, 2017 (DE) ..... 10 2017 114 575

(51) Int. Cl.
*F01L 13/00* (2006.01)
*F01L 1/18* (2006.01)

(52) U.S. Cl.
CPC ..... *F01L 13/0042* (2013.01); *F01L 1/18* (2013.01); *F01L 13/0036* (2013.01); *F01L 2013/0052* (2013.01)

(58) Field of Classification Search
CPC ..... F01L 13/0042; F01L 13/0036; F01L 2013/0052; F01L 1/267; F01L 2001/0473; F01L 1/053; F01L 1/181; F01L 1/047; F01L 2013/105
USPC ..... 123/90.18, 90.12, 90.13, 90.15, 90.16, 123/90.27, 90.44
See application file for complete search history.

(56) References Cited

U.S. PATENT DOCUMENTS 8,851,035 B2 * 10/2014 Gunnel ..... F01L 13/0036 123/90.18
10,473,003 B2 * 11/2019 Altherr ..... F01L 13/00
2002/0023604 A1 * 2/2002 Nohara ..... F01L 1/3442 123/90.15
2012/0204824 A1 * 8/2012 Kamichika ..... F01L 1/047 123/90.15

(Continued)

FOREIGN PATENT DOCUMENTS

DE 19611641 C1 6/1997
DE 19945340 A1 3/2001

(Continued)

*Primary Examiner* — Devon C Kramer
*Assistant Examiner* — Kelsey L Stanek
(74) *Attorney, Agent, or Firm* — Weber Rosselli & Cannon LLP

(57) ABSTRACT

The disclosure concerns a variable valve train for an internal combustion engine, comprising a camshaft, a gas exchange valve and a cam carrier. The cam carrier is arranged rotationally fixedly and axially displaceably on the camshaft and has a first cam and a second cam. The variable valve train has a force transmission device with a force transmission element, in particular a finger follower or rocker arm, which, depending on an axial position of the cam carrier, creates an active connection either between the first cam and the gas exchange valve or between the second cam and the gas exchange valve. The variable valve train has a first actuator for axial displacement of the cam carrier, wherein the first actuator is received at least partially in the force transmission device.

19 Claims, 4 Drawing Sheets

(56) References Cited

U.S. PATENT DOCUMENTS

| | | | | |
|---|---|---|---|---|
| 2013/0042830 | A1* | 2/2013 | Kawata | F01L 1/185<br>123/90.16 |
| 2017/0101906 | A1* | 4/2017 | Miyazato | F01L 1/181 |
| 2017/0284236 | A1* | 10/2017 | Ahmed | F01L 1/18 |
| 2017/0284240 | A1* | 10/2017 | Takada | F01L 1/022 |
| 2017/0284241 | A1* | 10/2017 | Kataoka | F01L 13/0063 |
| 2017/0362970 | A1* | 12/2017 | Niekamp | F01L 13/0036 |
| 2019/0032521 | A1* | 1/2019 | Hirschmann | F01L 1/267 |
| 2019/0085737 | A1* | 3/2019 | Takada | F01L 13/00 |

FOREIGN PATENT DOCUMENTS

| | | | |
|---|---|---|---|
| DE | 102010013216 | A1 | 10/2010 |
| DE | 102011050484 | A1 | 11/2012 |
| DE | 102015213266 | A1 | 1/2017 |
| DE | 102017205463 | A1 | 10/2017 |
| JP | H0333412 | A | 2/1991 |
| JP | 3365805 | B2 | 1/2003 |
| JP | 2011226422 | A | 11/2011 |
| JP | 5793070 | B2 | 10/2015 |

* cited by examiner

VARIABLE VALVE TRAIN

BACKGROUND

The disclosure concerns a variable valve train for an internal combustion engine.

Valve-controlled internal combustion engines have one or more controllable inlet and exhaust valves per cylinder. Variable valve trains allow flexible actuation of the valves in order to change the opening time, closing time and/or valve lift. In this way, the engine operation may be adapted for example to a specific load situation. For example, a variable valve train may be implemented by a so-called sliding cam system.

DE19,611,641 C1 describes an example of such a sliding cam system with which a gas exchange valve can be actuated with several different lift curves. For this, a sliding cam with at least one cam portion having several cam tracks is mounted rotationally fixedly but axially displaceably on the camshaft; said cam has a lift contour in which an actuator in the form of a pin is introduced radially from the outside in order to produce an axial displacement of the sliding cam. The axial displacement of the sliding cam sets a different valve lift for the respective gas exchange valve. After its axial displacement relative to the camshaft, the sliding cam is locked in its relative axial position on the camshaft by at least one spring-loaded locking ball which is received and mounted in the camshaft and engages in at least one locking groove depending on the relative axial position.

The sliding cam system may take up considerable installation space. In particular, an arrangement of the actuators for displacing a cam carrier (sliding cam) may constitute a challenge when spatial conditions are restricted. Typically, the actuators are attached to a frame connected to the cylinder head or cylinder head cover.

DE10,2011/050,484 A1 discloses an internal combustion engine with several cylinders, a cylinder head and a cylinder head cover. To actuate the gas exchange valves, at least one rotatably mounted camshaft is provided, with at least one sliding cam which is axially displaceable on the respective camshaft. Each sliding cam has at least one sliding block guide portion with at least one groove. An actuator is provided to achieve an axial displacement of the respective sliding cam. The actuator is mounted in the cylinder head or in the cylinder head cover.

SUMMARY

The present disclosure is directed to providing an improved or alternative variable valve train with a sliding cam system, which is structured optimally with regard to installation space.

The variable valve train for an internal combustion engine has a camshaft, a gas exchange valve and a cam carrier (sliding cam). The cam carrier is arranged rotationally fixedly and axially displaceably on the camshaft and has a first cam and a second cam. The variable valve train has a force transmission device with a force transmission element, in particular a finger follower or rocker arm, which, depending on an axial position of the cam carrier, creates an active connection either between the first cam and the gas exchange valve or between the second cam and the gas exchange valve. The variable valve train has a first actuator for axial displacement of the cam carrier, wherein the first actuator is received at least partially in the force transmission device.

Because the first actuator is received in the force transmission device which is present in any case, little or no additional installation space is required for the first actuator. In addition, a control device for actuating the first actuator may be provided in the force transmission device.

In particular, the first cam and the second cam may be arranged adjacent to each other and/or have different cam contours.

For example, the different cam contours of the first cam and the second cam may serve to reduce fuel consumption, for heat management or to implement an engine brake.

Preferably, the cam carrier and the first actuator may form a sliding cam system.

In a particularly preferred embodiment, the force transmission device has a lever shaft, in particular a rocker arm shaft or a finger follower shaft. The first actuator is received at least partially in the lever shaft.

In particular, the rocker arm shaft may mount the force transmission element pivotably.

In a further exemplary embodiment, the force transmission device has a lever shaft bearing block and the first actuator is received at least partially in the lever shaft bearing block.

The lever shaft bearing block may support a lever shaft of the force transmission device which pivotably mounts the force transmission element.

In a further exemplary embodiment, the first actuator is received at least partially in the force transmission element.

In an embodiment variant, the first actuator is electromagnetically, pneumatically and/or hydraulically actuated. Alternatively or additionally, a control line (for example, an electric, pneumatic and/or hydraulic control line) for actuating the first actuator is received at least partially in the force transmission device (for example, the force transmission element, the lever shaft and/or the lever shaft bearing block).

In a refinement, the first actuator comprises an extendable and retractable pin which may be brought into engagement with a first engagement track extending preferably helically around the longitudinal axis of the camshaft, for axial displacement of the camshaft. When engaged with the engagement track, the pin—which is stationary relative to an axial direction of the camshaft—may axially displace the cam carrier.

The pin may be retracted and extended in a direction running radially to a longitudinal axis of the camshaft.

In a further embodiment variant, the first actuator comprises a preferably hydraulic lift device with a first cylinder and a control piston which is arranged movably in the first cylinder. The control piston is actively connected with or formed integrally with the pin. Thus the pin may be extended via the control piston.

In one embodiment, the lift device is arranged movably in a second cylinder of the first actuator. Thus the lift device may be moved in particular in a direction opposite the cam carrier, in order to disengage the pin of the actuator from the engagement track.

In a further embodiment, a push-out ramp is arranged at one end of the first engagement track, and when the pin leaves the track, moves the lift device in the second cylinder from a first position to a second position, in a direction opposite the cam carrier.

In a yet another embodiment, a first elastic element, in particular a spring, pretensions the lift device in a direction towards the first position. Thus a movement of the lift device from the first position to the second position takes place against the pretension force of the first elastic element.

In a further exemplary embodiment, the first actuator furthermore comprises a control fluid supply channel which, in the first position of the lift device, is fluidically connected to a control fluid chamber of the lift device. Alternatively or additionally, the first actuator comprises a control fluid discharge channel which, in the second position of the lift device, is fluidically connected to a control fluid chamber of the lift device. Thus the control fluid may be supplied or discharged depending on the position (setting) of the lift device.

In a further embodiment variant, the first actuator comprises a second elastic element, in particular a spring, which pretensions the control piston in a direction opposite the cam carrier.

In another embodiment, the variable valve train furthermore comprises a second actuator for axial displacement of the cam carrier. The second actuator is at least partially received in the force transmission device, in particular a lever shaft of the force transmission device, a lever shaft bearing block of the force transmission device and/or the force transmission element of the force transmission device. Thus the same installation space advantages can be achieved with a second actuator as with the first actuator.

In particular, the second actuator may be configured like the first actuator.

The first actuator and the second actuator may be formed separately from each other. It is however also possible that the first actuator and the second actuator form an integral actuator device in a common housing.

Preferably, the first actuator may move the cam carrier from a first axial position to a second axial position, and the second actuator may move the cam carrier from the second axial position to the first axial position.

In a further embodiment, the variable valve train comprises a control fluid supply device for the first actuator and/or the second actuator. The control fluid supply device has a bearing block which mounts the camshaft rotatably. The bearing block has a first control fluid supply channel and a second control fluid supply channel arranged downstream of the first control fluid supply channel. The first control fluid supply channel and the second control fluid supply channel can be brought selectively into fluidic connection depending on a rotary angle of the camshaft, in particular via a channel, preferably a transverse channel of the camshaft.

In particular, the first control fluid supply channel may be arranged downstream of a high-pressure chamber.

The second control fluid supply channel may be arranged upstream of the control fluid chamber.

The disclosure furthermore concerns a motor vehicle, in particular a utility vehicle (for example a bus or truck) with a variable valve train as disclosed herein.

According to a further aspect of the present application, the configuration described herein of the first actuator and/or the second actuator is disclosed independently of its/their arrangement in the force transmission device. This means that the first actuator and/or the second actuator may also not be arranged inside the force transmission device. The first actuator and/or the second actuator may be configured as disclosed herein. According to this aspect, the application achieves amongst others the object of providing an alternative and/or improved hydraulic actuator for a sliding cam system.

The embodiments and features of the disclosure described above may be combined with each other in arbitrary fashion.

BRIEF DESCRIPTION OF THE FIGURES

Further details and advantages of the disclosure are described below with reference to the attached drawings. The drawings show.

The embodiments shown in the figures correspond at least partially, so similar or identical parts carry the same reference signs, and for their explanation reference is also made to the description of the other embodiments or figures in order to avoid repetition.

DETAILED DESCRIPTION

Figure 1:
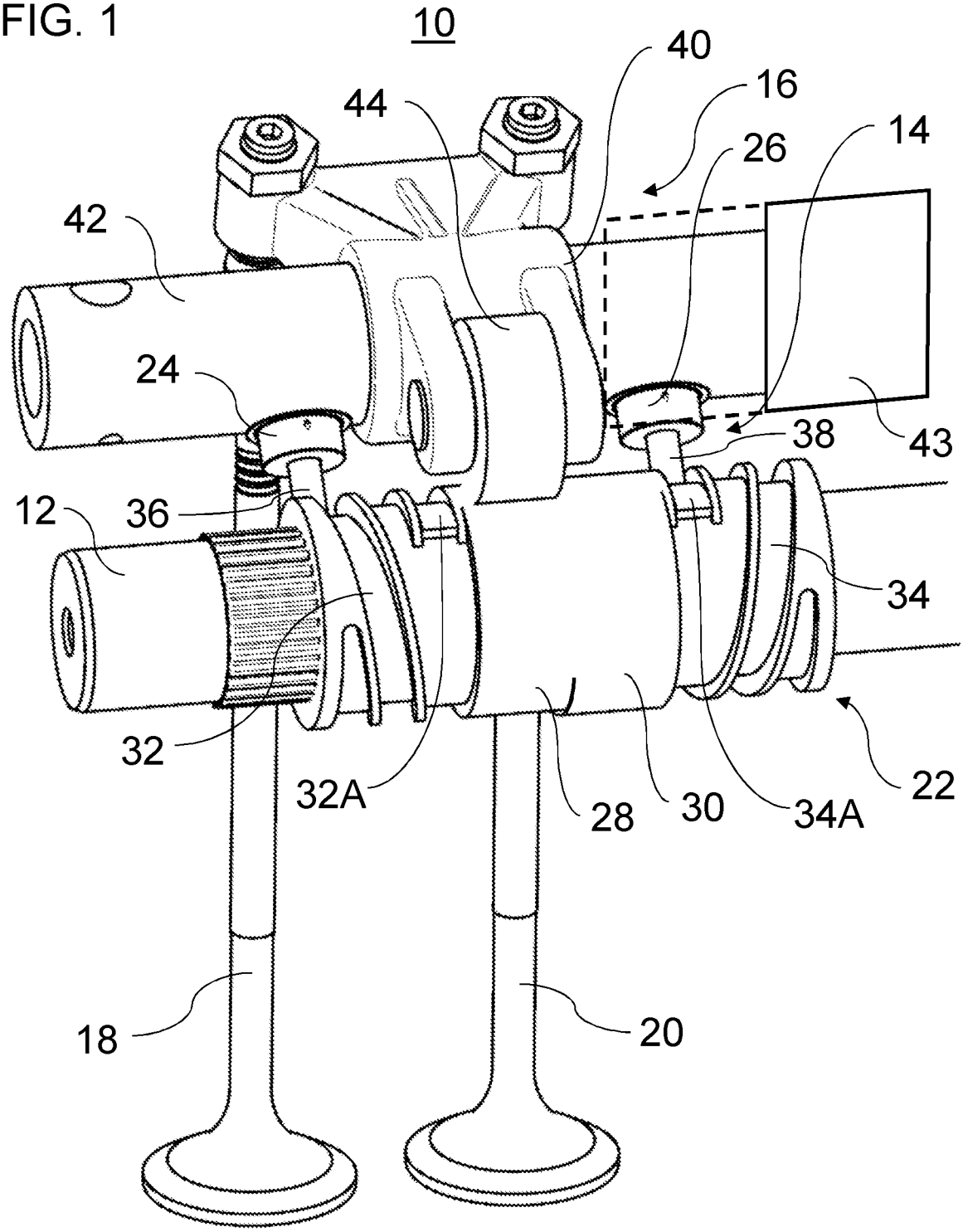
FIG. 1 a perspective view of a variable valve train.
Figure 1A:
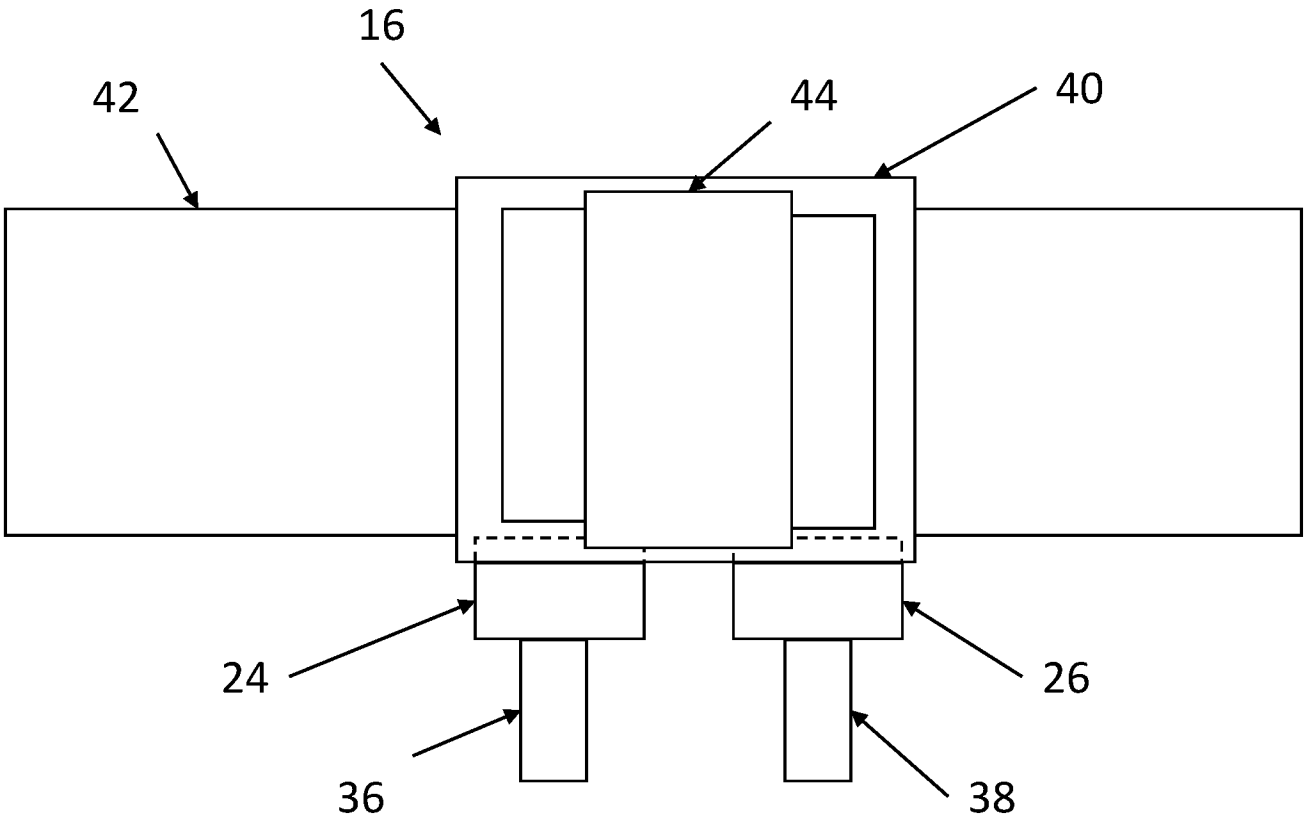
Figure 1B:
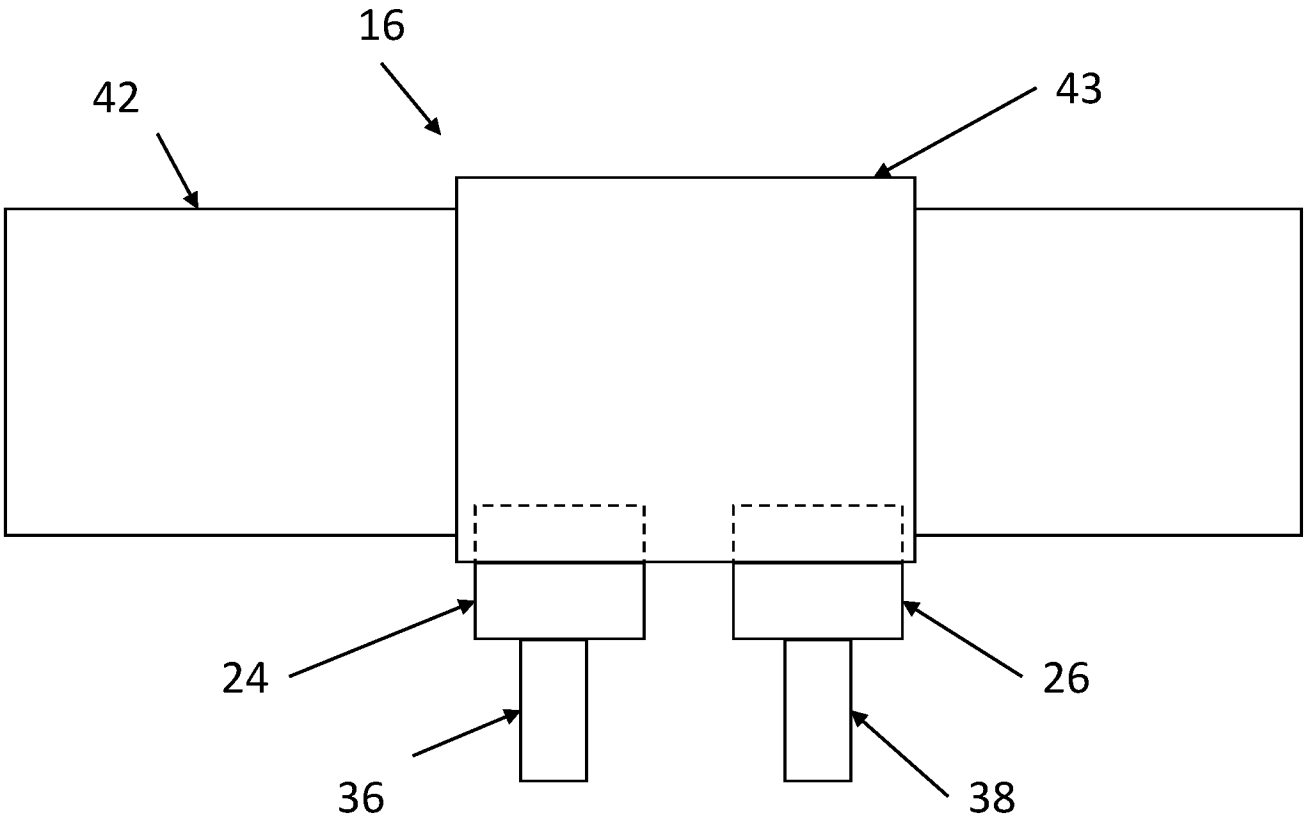

FIG. 1 shows a variable valve train 10. The variable valve train 10 has a camshaft 12, a sliding cam system 14, a force transmission device 16, a first gas exchange valve 18 and a second gas exchange valve 20. The gas exchange valves 18, 20 may be inlet valves or exhaust valves.

The variable valve train 10 may be used to adapt the valve control curves of the first and second gas exchange valves 18, 20. The variable valve train 10 is assigned to an internal combustion engine (not shown). The internal combustion engine may be used for example in a utility vehicle, for example a bus or a truck.

The camshaft 12 is arranged as an overhead camshaft (OHC). The camshaft 12 may be provided as part of a double overhead camshaft (DOHC) or as a single overhead camshaft (SOHC).

The sliding cam system 14 has a cam carrier 22, a first actuator 24 and a second actuator 26.

The cam carrier 22 is arranged rotationally fixedly and axially displaceably on the camshaft 12. The cam carrier 22 has a first cam 28, a second cam 30, a first engagement track (sliding block guide) 32 and a second engagement track (sliding block guide) 34.

The first cam 28 and the second cam 30 have different cam contours for producing different valve control curves. The different cam contours may be used for example to reduce fuel consumption, for heat management or to implement an engine brake.

The first cam 28 and the second cam 30 are arranged offset to each other along the longitudinal axis of the camshaft 12. In detail, the first cam 28 and the second cam 30 are arranged adjacent to each other in a central portion of the cam carrier 22. In other embodiments, additional cams and/or alternative cam arrangements may be provided. For example, each gas exchange valve may have a rocker arm to which at least two cams of the cam carrier are assigned. It is also possible that one cam carrier carries the cams for the gas exchange valves of two adjacent cylinders.

The first engagement track 32 is provided in a first end region of the cam carrier 22. The second engagement track 34 is provided in an opposite, second end region of the cam carrier 22. The first and second engagement tracks 32, 34 extend helically around a longitudinal axis of the camshaft 12 as depressions (grooves) in the cam carrier 22. In other embodiments, at least one of the engagement tracks may not be arranged at an axial end region of the cam carrier. For example, an engagement track may be arranged between two cams of the cam carrier.

To displace the cam carrier 22 axially, radially movable pins 36, 38 of the actuators 24, 26 may selectively engage (catch) in the engagement tracks 32, 34. In detail, the pin 36 of the first actuator 24 may selectively engage in the first engagement track 32 in order to move the cam carrier 22 from a first axial position to a second axial position. The pin 36 is moved radially relative to a longitudinal axis of the camshaft 12. In FIG. 1, the cam carrier 22 is shown in the first axial position. The pin 38 of the second actuator 26 in turn may selectively engage in the second engagement track 34. The cam carrier 22 is then moved from the second axial position to the first axial position.

The axial displacement of the cam carrier 22 is triggered when the extended pin 36, 38 of the respective actuator 24, 26 is stationary relative to an axial direction of the camshaft 12. Consequently, the movable cam carrier 22 is displaced in a longitudinal direction of the camshaft 12, because of the helical form of the engagement tracks 32, 34, when one of the extended pins 36 or 38 engages in the respective engagement track 32, 34. At the end of the axial displacement process, the extended pin 36 or 38 of the respective actuator 24, 26 is guided out of the respective engagement track 32, 34 via a push-out ramp 32A, 34A opposite the extension direction, and hence retracted. The pin 36, 38 of the respective actuator 24, 26 disengages from the respective engagement track 32, 34.

The actuators 24, 26 may be actuated electromagnetically, pneumatically and/or hydraulically. A particularly preferred exemplary embodiment of the actuators 24, 26 with hydraulic actuation is described later herein with reference to FIGS. 2 and 3.

The sliding cam system 14 may additionally have a locking device (not shown). The locking device may be configured such that it axially secures the cam carrier 22 in the first axial position and in the second axial position. For this, the locking device may for example have an elastically pretensioned blocking body. In the first axial position of the cam carrier 22, the blocking body may engage in a first recess of the cam carrier, and in the second axial position of the cam carrier 22, it may engage in the second recess of the cam carrier 22. The locking device may for example be provided in the camshaft 12.

The force transmission device 16 has a force transmission element 40, a lever shaft 42 and a multiplicity of lever shaft bearing blocks 43 (only one lever axle bearing block is shown diagrammatically in FIG. 1) for mounting the lever shaft 42. The force transmission element 40 is arranged rotatably on the lever shaft 42.

In the embodiment shown, the force transmission element 40 is configured as a rocker arm, and the lever shaft 42 is therefore configured as a rocker arm shaft. It is however also possible that the force transmission element 40 is configured for example as a finger follower.

The force transmission element 40 has a cam follower 44, for example in the form of the rotatably mounted roller. The cam follower 44 follows a cam contour of the first cam 28 or of the second cam 30 depending on an axial position of the cam carrier 22.

In the first axial position of the cam carrier 22, the force transmission element 40 is actively connected between the first cam 28 and the gas exchange valves 18 and 20 via the cam follower 44. The gas exchange valves 18 and 20 are actuated according to the cam contour of the first cam 28. This situation is shown in FIG. 1. In the second axial position of the cam carrier 22, the force transmission element 40 is actively connected between the second cam 30 and the gas exchange valves 18 and 20 via the cam follower 44. The gas exchange valves 18 and 20 are actuated according to the cam contour of the second cam 30.

The first actuator 24 and the second actuator 26 are partially received in the lever shaft 42 (integrated). This is especially advantageous, in particular with regard to optimal use of installation space, since the actuators 24 and 26 thus require little or no separate installation space. To achieve the same advantage, it is also possible to integrate the first actuator 24 and the second actuator 26 in the lever shaft bearing blocks of the lever shaft 42. As a further example, it is also possible—if the force transmission element 40 is dimensioned correspondingly large—to integrate the actuators 24 and 26 directly in the force transmission element 40.

Figure 2:
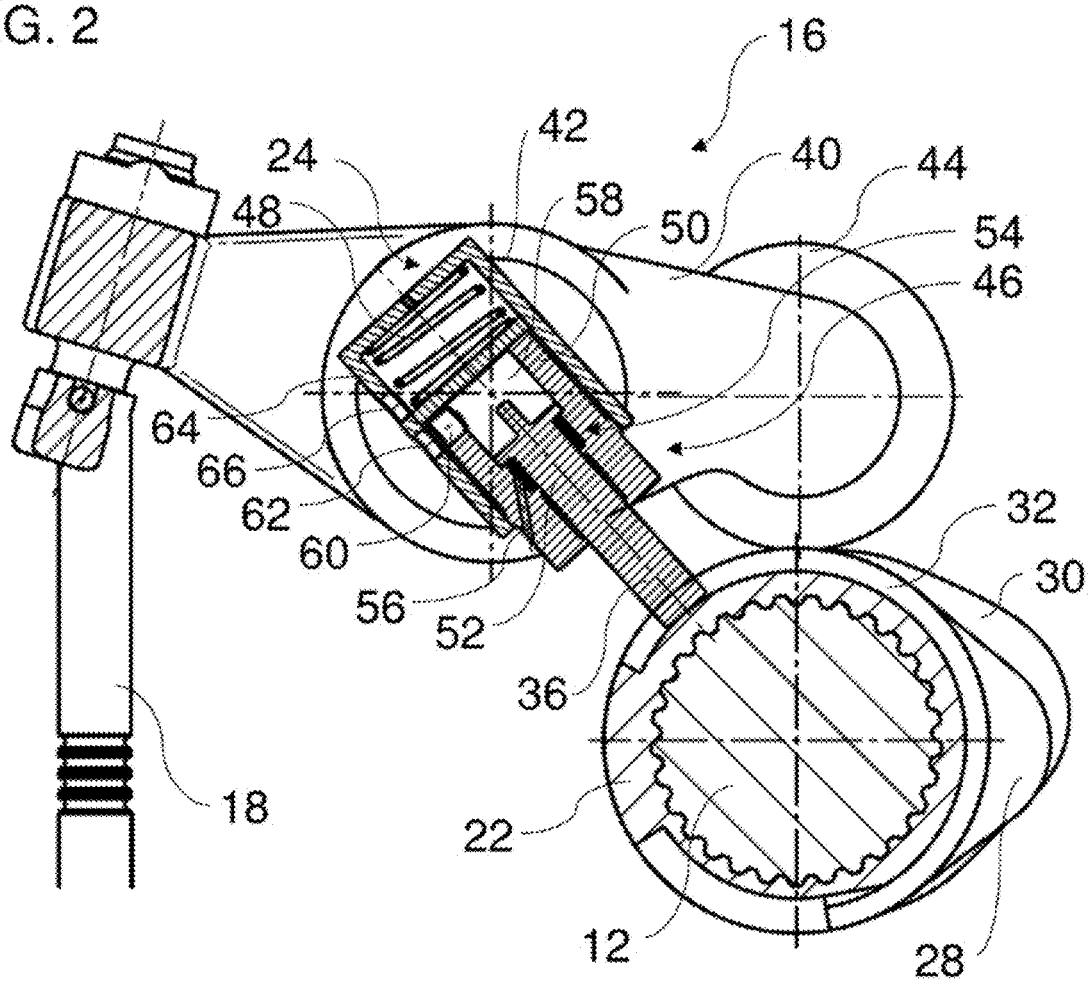
FIG. 2 a sectional view through the variable valve train.

FIG. 2 shows a section through the first actuator 24. The second actuator 26 may be configured like the first actuator 24. The first actuator 24 comprises the pin 36, a hydraulic lift device 46 and a first elastic element 48.

The hydraulic lift device 46 comprises a first cylinder 50, a control piston 52, a second elastic element 54 and a purge channel 56.

The control piston 52 is arranged longitudinally movably in a control fluid chamber 58 of the first cylinder 50. The control piston 52 is configured integrally with the pin 36. It is however also possible, for example, for the pin to be actively connected to the control piston of the lift device.

The control fluid chamber 58 may be filled with a control fluid via a control fluid channel 60. If a displacement of the cam carrier 22 (see FIG. 1) from the first axial position to the second axial position is desired, the control fluid chamber 58 is filled with additional control fluid. In detail, the control fluid passes from a feed channel 62 via the control fluid channel 60 into the control fluid chamber 58. The feed channel 62, as part of a control line for actuating the first actuator 24, is received at least partially in the lever shaft 42. The pressure in the control fluid chamber 58 rises due to the infeed of control fluid. The control piston 52 and hence the pin 36 move in the first cylinder 50 in a direction towards the camshaft 22, in order to catch (engage) in the first engagement track 32 as shown in FIG. 2. The control piston 52 moves against a pretension force (return force) of the second elastic element 54. The second elastic element 54 may for example be a coil spring. Leakage fluid which has penetrated from the control fluid chamber 58 into the ring chamber of the second elastic element 54 may be discharged via the purge channel 56.

At the end of the axial displacement of the cam carrier 22 (see FIG. 1), the pin 36 reaches the push-out ramp 32A. The push-out ramp 32A presses the pin 36 in a direction towards the control fluid chamber 58. The high pressure in the control fluid chamber 58 prevents the pin 36, together with the control piston 52, from entering the control fluid chamber 58. The pin 36 and the control piston 52 do not enter the first cylinder 50. Instead, the lift device 46 as a whole is moved (retracted) against a pretension force (return force) of the first elastic element 48 inside a second cylinder 64 of the actuator 24.

The first elastic element 48 may for example be a coil spring. A chamber which receives the first elastic element 48 may be substantially free from control fluid. When the lift device 46 is retracted, a fluidic connection is created between the control fluid channel 60 and a discharge channel 66. The increased pressure still prevailing in the control fluid chamber 58 diminishes. The control piston 52 is retracted into the first cylinder 50 by the force of the second elastic element 54. The pin 36 is no longer in contact with the first engagement track 32. The pretension force of the first elastic element 48 presses the lift device 46 back into the starting position.

Figure 3:
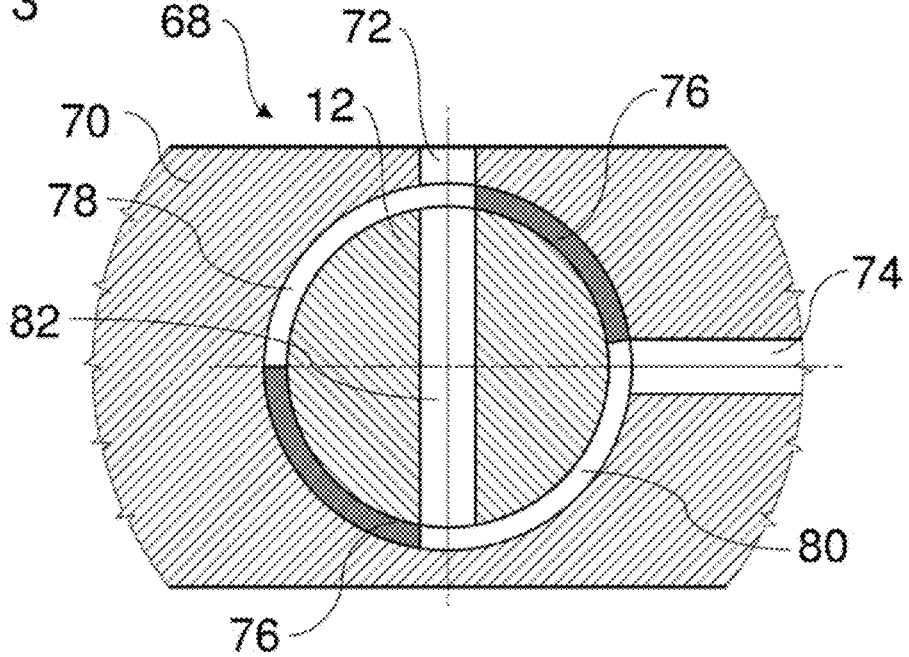
FIG. 3 a diagrammatic, sectional view through a camshaft and a bearing block.

FIG. 3 shows diagrammatically how a control fluid supply to the actuators 24, 26 may be configured depending on a rotary angle of the camshaft 12. By means of the control fluid supply, it may for example be guaranteed that switching between the cams 28, 30 takes place (an axial displacement of the cam carrier 22 is performed) only within a base circle region of the cams 28, 30.

A control fluid supply device 68 is integrated in a bearing block 70 and the camshaft 12. The bearing block 70 has a first supply channel 72 and a second supply channel 74. The camshaft 12 is mounted in the bearing block 70 via a one-piece or a multipiece bearing shell 76. The bearing shell 76 comprises passages so that ring segment channels 78, 80 are formed between the camshaft 12 and the bearing block 70. The camshaft 12 also has a transverse channel 82. The transverse channel 82 extends perpendicularly to a longitudinal axis of the camshaft 12 and may for example be formed as a passage channel.

The first supply channel 72 is arranged upstream of the second supply channel 74. The first supply channel 72 is arranged downstream of a high-pressure chamber. The second supply channel 74 is arranged upstream of the feed channel 62. Depending on a rotary position of the camshaft 12, a fluidic connection is created between the first supply channel 72 and the second supply channel 74 via the ring segment channels 78, the transverse channel 82 and the ring segment channel 80. In other words, the transverse channel 82 connects the supply channels 72 and 74 together selectively depending on a rotary angle of the camshaft 12. If, in the example shown, the camshaft 12 rotates for example through 90° counterclockwise (from 12 o'clock to 9 o'clock), the fluidic connection between the supply channels 72 and 74 is maintained during this rotation. During the next 90° rotation of the camshaft counterclockwise (9 o'clock to 6 o'clock) however, there is no fluidic connection between the supply channels 72 and 74. The supply channels 72 and 74 are not connected via the ring segment channels 78, 80 and the transverse channel 82.

The configuration of the control fluid supply device 68 shown in FIG. 3 is intended to illustrate, purely diagrammatically, how a control fluid supply depending on the camshaft angle can be implemented. The practical implementation may evidently deviate, in particular in relation to the angular ranges of the ring segment channels 78, 80 shown.

The disclosure is not restricted to the exemplary embodiments described above. Rather, a plurality of variants and derivatives are possible which also make use of the inventive concept and therefore fall within the scope of protection.

LIST OF REFERENCE SIGNS

10 Variable valve train
12 Camshaft
14 Sliding cam system
16 Force transmission device
18 First gas exchange valve
20 Second gas exchange valve
22 Cam carrier
24 First actuator
26 Second actuator
28 First cam
30 Second cam
32 First engagement track
32A Push-out ramp
34 Second engagement track
34A Push-out ramp
36 Pin
38 Pin
40 Force transmission element (rocker arm)
42 Lever shaft
43 Lever shaft bearing block
44 Cam follower
46 Lift device
48 First elastic element
50 First cylinder
52 Control piston
54 Second elastic element
56 Purge channel
58 Control fluid chamber
60 Control fluid channel
62 Feed channel
64 Second cylinder
66 Discharge channel
68 Control fluid supply device
70 Bearing block
72 First supply channel
74 Second supply channel
76 Bearing shell
78 First ring segment channel
80 Second ring segment channel
82 Transverse channel

We claim:

1. A variable valve train for an internal combustion engine, comprising:

a camshaft;

a gas exchange valve;

a cam carrier which is arranged rotationally fixedly and axially displaceably on the camshaft and has a first cam and a second cam;

a force transmission device with a force transmission element, which, depending on an axial position of the cam carrier, creates an active connection either between the first cam and the gas exchange valve or between the second cam and the gas exchange valve; and a first actuator for axial displacement of the cam carrier, wherein the first actuator is received at least partially in the force transmission device;

furthermore comprising a control fluid supply device for the first actuator, and including:

a bearing block which mounts the camshaft rotatably and has a first control fluid supply channel and a second control fluid supply channel arranged downstream of the first control fluid supply channel, wherein the first control fluid supply channel and the second control fluid supply channel can be brought selectively into fluidic connection depending on a rotary angle of the camshaft via a channel.

2. The variable valve train according to claim 1, wherein:

the force transmission device has a lever shaft, and the first actuator is received at least partially in the lever shaft.

3. The variable valve train according to claim 2, wherein the lever shaft is a rocker arm shaft or a finger follower shaft.

4. The variable valve train according to claim 1, wherein:

the force transmission device has a lever shaft bearing block, and the first actuator is received at least partially in the lever shaft bearing block.

5. The variable valve train according to claim 1, wherein:

the first actuator is received at least partially in the force transmission element.

6. The variable valve train according to claim 1, wherein:

the first actuator is electromagnetically, pneumatically or hydraulically actuated; and a control line for actuating the first actuator is received at least partially in the force transmission device.

7. The variable valve train according to claim 1, wherein the first actuator comprises:

an extendable and retractable pin which can be brought into engagement with a first engagement track extending around longitudinal axis of the camshaft, for axial displacement of the camshaft.

8. The variable valve train according to claim 7, wherein the first actuator comprises a lift device with a first cylinder and a control piston which is arranged movably in the first cylinder, wherein the control piston is actively connected with or formed integrally with the pin.

9. The variable valve train according to claim 8, wherein:

the lift device is arranged movably in a second cylinder of the first actuator.

10. The variable valve train according to claim 9, wherein:

a push-out ramp is arranged at one end of the first engagement track and, when the pin leaves the track, the push-out ramp moves the lift device in the second cylinder from a first position to a second position in a direction opposite the cam carrier.

11. The variable valve train according to claim 10, wherein a first elastic element pretensions the lift device in a direction towards the first position.

12. The variable valve train according to claim 10, wherein the first actuator furthermore comprises:

a control fluid supply channel which, in the first position of the lift device, is fluidically connected to a control fluid chamber of the lift device; or a control fluid discharge channel which, in the second position of the lift device, is fluidically connected to a control fluid chamber of the lift device.

13. The variable valve train according to claim 8, wherein the first actuator furthermore comprises:

a second elastic element which pretensions the control piston in a direction opposite the cam carrier.

14. The variable valve train according to claim 8, wherein the lift device is a hydraulic lift device.

15. The variable valve train according to claim 1, furthermore comprising a second actuator for axial displacement of the cam carrier, wherein:

the second actuator is at least partially received in the force transmission device; or the second actuator is configured like same as the first actuator.

16. The variable valve train according to claim 1, wherein the channel is a transverse channel of the camshaft.

17. The variable valve train according to claim 1, wherein the force transmission element is a finger follower or a rocker arm.

18. A motor vehicle comprising:

an internal combustion engine; and a variable valve train including, a camshaft;

a gas exchange valve;

a cam carrier which is arranged rotationally fixedly and axially displaceably on the camshaft and has a first cam and a second cam;

a force transmission device with a force transmission element which, depending on an axial position of the cam carrier, creates an active connection either between the first cam and the gas exchange valve or between the second cam and the gas exchange valve; and a first actuator for axial displacement of the cam carrier, wherein the first actuator is received at least partially in the force transmission device;

furthermore comprising a control fluid supply device for the first actuator, and including:

a bearing block which mounts the camshaft rotatably and has a first control fluid supply channel and a second control fluid supply channel arranged downstream of the first control fluid supply channel, wherein the first control fluid supply channel and the second control fluid supply channel can be brought selectively into fluidic connection depending on a rotary angle of the camshaft via a channel.

19. The variable valve train according to claim 18, furthermore comprising a second actuator for axial displacement of the cam carrier, wherein:

the second actuator is at least partially received in the force transmission device; or the second actuator is configured the same as the first actuator.

* * * * *